US009887056B2

(12) United States Patent
Lee

(10) Patent No.: US 9,887,056 B2
(45) Date of Patent: Feb. 6, 2018

(54) METHOD OF FABRICATING A RELAY

(71) Applicant: LSIS CO., LTD., Anyang-si, Gyeonggi-do (KR)

(72) Inventor: Kwangsik Lee, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 15/145,691

(22) Filed: May 3, 2016

(65) Prior Publication Data

US 2017/0018386 A1 Jan. 19, 2017

(30) Foreign Application Priority Data

Jul. 19, 2015 (KR) ..... 10-2015-0101217

(51) Int. Cl.
*H01H 11/00* (2006.01)
*H01H 65/00* (2006.01)
(Continued)

(52) U.S. Cl.
CPC ..... *H01H 51/065* (2013.01); *H01F 1/0302* (2013.01); *H01F 7/021* (2013.01);
(Continued)

(58) Field of Classification Search
CPC ..... H01H 33/20; H01H 33/70; H01H 33/182; H01H 73/045; H01H 1/06; H01H 3/28;
(Continued)

(56) References Cited

U.S. PATENT DOCUMENTS 8,198,964 B2 * 6/2012 Yoshihara ..... H01H 51/29 335/131
9,154,004 B2 * 10/2015 Iwasaki ..... B22F 3/24
2016/0115960 A1 * 4/2016 Fournier ..... F01P 5/14 123/41.44

FOREIGN PATENT DOCUMENTS

CN 102194611 9/2011
CN 102483980 5/2012
(Continued)

OTHER PUBLICATIONS

State Intellectual Property Office of the People's Republic of China Application Serial No. 201610472245.3, Office Action dated Nov. 30, 2017, 9 pages.

*Primary Examiner* — Thiem Phan
(74) *Attorney, Agent, or Firm* — Lee Hong Degerman Kang & Waimey

(57) ABSTRACT

The present invention relates to a relay for an electric vehicle and a method of manufacturing the same, and more particularly, a relay for an electric vehicle where a permanent magnet is integrally formed with a housing formed of a ceramic chamber, and a method of manufacturing the same. The relay, capable of rapidly executing current interruption includes: a fixed contact; a movable contact formed to contact or to be separated from the fixed contact; a shaft connected to the movable contact, and configured to move the movable contact; a housing configured to accommodate therein the fixed contact and the movable contact; an actuator configured to drive the shaft; and a permanent magnet integrally formed with the housing, and configured to extend an arc generated between the fixed contact and the movable contact. The permanent magnet includes an alnico-based material or a neodymium-based material.

3 Claims, 4 Drawing Sheets

(51) Int. Cl.

| | |
|---|---|
| ***H01H 51/06*** | (2006.01) |
| ***H01H 49/00*** | (2006.01) |
| ***H01F 1/03*** | (2006.01) |
| ***H01H 9/44*** | (2006.01) |
| ***H01H 50/02*** | (2006.01) |
| ***H01F 7/02*** | (2006.01) |
| ***H01F 41/02*** | (2006.01) |

(52) U.S. Cl.
CPC ..... *H01F 41/0266* (2013.01); *H01H 9/443* (2013.01); *H01H 49/00* (2013.01); *H01H 50/02* (2013.01); *Y10T 29/49105* (2015.01)

(58) Field of Classification Search
CPC .. H01H 67/02; H01H 9/30; B22F 3/10; H01F 1/0577; H01F 41/0266; H01F 7/021; H01F 1/086; H01F 41/0253; Y10T 29/49075; Y10T 29/49803; Y10T 29/49105
USPC ..... 335/201, 78, 128, 131, 132, 176, 194, 335/196, 202; 29/622, 419.2, 421.1, 607
See application file for complete search history.

(56) References Cited

FOREIGN PATENT DOCUMENTS

| | | |
|---|---|---|
| CN | 104008922 | 8/2014 |
| EP | 2838100 | 2/2015 |
| JP | 4038950 | 1/2008 |
| JP | 2011228087 | 11/2011 |
| JP | 5673878 | 2/2015 |
| JP | 5684650 | 3/2015 |
| WO | 2014006871 | 1/2014 |
| WO | 2014198326 | 12/2014 |

* cited by examiner

METHOD OF FABRICATING A RELAY

CROSS-REFERENCE TO RELATED APPLICATION

Pursuant to 35 U.S.C. § 119(a), this application claims the benefit of earlier filing date and right of priority to Korean Application No. 10-2015-0101217, filed on Jul. 19, 2015, the contents of which are all hereby incorporated by reference herein in its entirety.

BACKGROUND OF THE INVENTION

1. Field of the Invention

The present invention relates to a relay for an electric vehicle and a method of manufacturing the same, and more particularly, a relay which is for an electric vehicle and which has a permanent magnet integrally formed with a housing formed of a ceramic chamber, and a method of manufacturing the same.

2. Background of the Invention

Generally, an electric vehicle uses a motor using a battery power as a power source, and a hybrid electric vehicle uses a motor using an internal combustion engine and a battery power as a power source. In the electric vehicle or the hybrid electric vehicle, a plurality of batteries are connected to each other in series or in series and in parallel according to a required capacity, and are mounted to the vehicle in the form of a battery set. The plurality of batteries supply a power to a motor of the electric vehicle, thereby making the electric vehicle move.

Such an electric vehicle requires a circuit switching device for supplying a battery power to a motor or for interrupting power supply. As the circuit switching device, a direct current relay is mainly used. The relay is a type of electric circuit switching device for executing a mechanical driving and transmitting a current signal by using an electromagnet principle. Such a relay is disposed in a battery system, and supplies power to a motor or various components of an electric vehicle or interrupts power supply by switching a battery.

However, in case of using the relay as a circuit switching device, the following problems may occur.

Generally, a relay is provided with a fixed contact and a movable contact, and supplies power or interrupts power supply as the movable contact operated by an electric signal contacts or is separated from the fixed contact.

A high voltage is applied to the relay, and an arc and heat are generated from a region close to the contacts by the high voltage when the fixed contact and the movable contact are separated from each other for power interruption. However, since the arc is a current flow and the fixed contact and the movable contact are connected to each other by the arc, current interruption is delayed by the arc even when the movable contact and the fixed contact are separated from each other.

Since current interruption is not rapidly executed, driving of the relay may not be precisely controlled. Further, the contacts are continuously abraded as the contacts repeatedly contact or are separated from each other. This may cause the lifespan of the relay to be shortened.

SUMMARY OF THE INVENTION

Therefore, an aspect of the detailed description is to provide a relay capable of rapidly executing current interruption by having a permanent magnet which extends an arc, and a method of manufacturing the same.

Another aspect of the detailed description is to provide a relay having a permanent magnet integrally formed with a housing, and a method of manufacturing the same.

To achieve these and other advantages and in accordance with the purpose of this specification, as embodied and broadly described herein, there is provided a relay, including: a fixed contact; a movable contact formed to contact or to be separated from the fixed contact; a shaft connected to the movable contact, and configured to move the movable contact; a housing configured to accommodate therein the fixed contact and the movable contact; an actuator configured to drive the shaft; and a permanent magnet integrally formed with the housing, and configured to extend an arc generated between the fixed contact and the movable contact.

The actuator may include: a magnetizing coil configured to generate an electromagnetic force; a fixed core and a movable core disposed in the magnetizing coil up and down; and a return spring disposed between the fixed core and the movable core, and configured to return the movable core to an original position.

To achieve these and other advantages and in accordance with the purpose of this specification, as embodied and broadly described herein, there is also provided a method of fabricating a relay, including: pre-molding powder for a permanent magnet and powder for ceramic; sintering the pre-molded powder, thereby forming a housing integrated with a permanent magnet; and providing a movable contact and a fixed contact in the housing, and assembling the housing with an electric actuator.

The powder for a permanent magnet may include: magnetic ferrite powder; and an alnico-based material or a neodymium-based material added to the magnetic ferrite powder.

The magnetic ferrite powder may have a size of 8-12 μm.

The powder for ceramic may include alumina powder, and the alumina powder may have a size of 8-12 μm.

The powder may be sintered by being heated at a temperature of 1350-1450° C. for 12 hours.

The present invention may have the following advantages.

Firstly, the relay is provided with the permanent magnet to induce an arc generated from the fixed contact and the movable contact, thereby extending a length of the arc. As the arc has an increased length, it may be rapidly removed. This may allow a current flow by the arc to be interrupted. Since a current may be rapidly supplied to a motor, components, etc. of an electric vehicle or the current supply may be rapidly interrupted, the motor or the components may be precisely controlled.

Secondly, since the permanent magnet is integrally formed with the housing, a size increase of the relay due to the permanent magnet may be prevented. This may maximize an arc extinguishing function of the relay without a size increase of the relay.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of preferred configurations of a relay which is for an electric vehicle and which includes a permanent magnet, and a method of manufacturing the same according to the present invention, with reference to the accompanying drawings.

Figure 1:
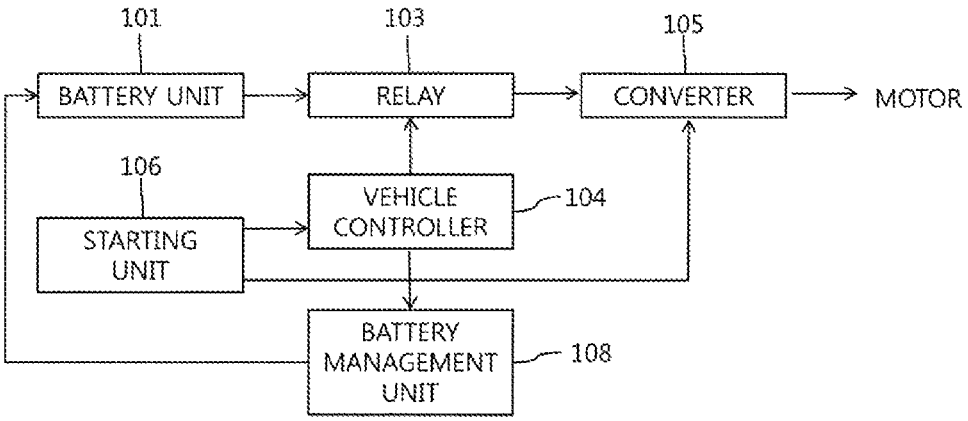
FIG. 1 is a block diagram illustrating a schematic structure of an electric vehicle according to the present invention.

FIG. 1 is a block diagram illustrating a schematic structure of an electric vehicle according to the present invention.

As shown in FIG. 1, the electric vehicle according to the present invention includes a battery unit 101 configured to store electric energy of a high voltage; a relay 103 connected to the battery unit 101, and configured to supply a current output from the battery unit 101 to a motor or to interrupt current supply to the motor; a converter 105 connected to the battery unit 101 through the relay 103, and configured to convert a current supplied from the battery unit 101 as the relay 103 is operated and configured to output the converted current to the motor; a battery management unit 190 configured to control electricity charging of the battery unit 101, configured to determine whether to charge the battery unit 101 based on a remaining current amount of the battery unit 101, and configured to supply a current stored in the battery unit 101 to the motor; a vehicle controller 104 configured to control on/off of the relay 103 and an operation of the converter 105; and a starting unit 106 configured to apply a starting signal to the vehicle controller 104.

The battery unit 101 is composed of a plurality of battery cells for storing electric energy of a high voltage, and is charged at a charging station, at a vehicle charging facility or at home by receiving power from the outside. The battery unit 101 supplies energy required to operate the electric vehicle or energy required to drive components such as an electronic power steering, a water pump, an air conditioner, a direction indicating lamp, a tail lamp, a head lamp and a brush.

The relay 103 is operated (open or closed) according to a control signal applied from the vehicle controller 104, and supplies a current charged in the battery unit 101 to the converter 105. That is, the relay 103 is operated according to a control command of the vehicle controller 104 when the vehicle is initially driven (started), thereby supplying a current to the converter 105. And the converter 105 converts the received current, and applies the converted current to a motor and each component of the electric vehicle.

The battery management unit 108 charges the battery cells of the battery unit 101, and prolongs a lifespan of the battery unit 101 by preventing over-charge or over-discharge of the battery unit 101 by constantly maintaining a voltage difference between the battery cells inside the battery unit 101 when the electric vehicle is operated. And the battery management unit 108 controls the electric vehicle to run for a long time through management of current usage, and measures a remaining current amount and a voltage of the battery unit 101 to output the measured values to the vehicle controller 104. Although not shown, the battery management unit 108 may include a protection circuit for protecting a current supplied to the battery unit 101.

The vehicle controller 104 transmits a relay driving signal for driving the relay 103, to the relay 103. As the relay 103 is driven, the battery unit 101 is electrically connected to the converter 105 and thus energy of the battery unit 101 is supplied to the converter 105.

The relay 103 controls an operation power of a high voltage not to be suddenly supplied to the vehicle when the vehicle is initially driven, thereby stably supplying power to the vehicle. The vehicle controller 104 controls on/off of the relay 103, and transmits and receives a control signal with the converter 105 to control the converter 105.

The starting unit 106 may include a starting switching portion configured to turn on/off a connected state between a vehicle key box and a vehicle accessory, and between a battery and a vehicle wire; and a starting driving unit configured to drive the starting switching portion. The starting unit 106 may include not only a starting key for starting a vehicle using a vehicle key, but also a start button.

Once the electric vehicle is started by the starting unit 106, a signal is applied to the vehicle controller 104 from the starting unit 106. And the vehicle controller 104 controls an overall control related to a vehicle driving. In this case, the vehicle controller 104 controls the battery unit 101 by the battery management unit 108.

The converter 105 transmits, to the vehicle controller 104, a relay driving command signal to request for driving of the relay 103. Then, the vehicle controller 104 which has received the relay driving command signal drives the relay 103. The converter 105 executes a PMW switching based on a control signal received from the vehicle controller 104, and converts a voltage of the battery unit 101 (about several hundreds of volts) into about 12V to supply the converted voltage to the motor and each component of the electric vehicle.

Figure 2:
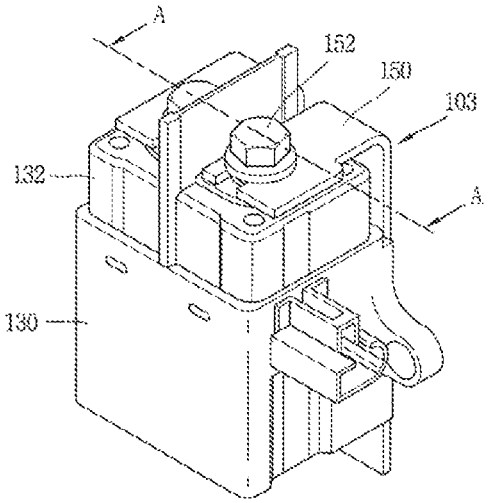
FIG. 2 is a perspective view of a relay according to a first embodiment of the present invention.
Figure 3:
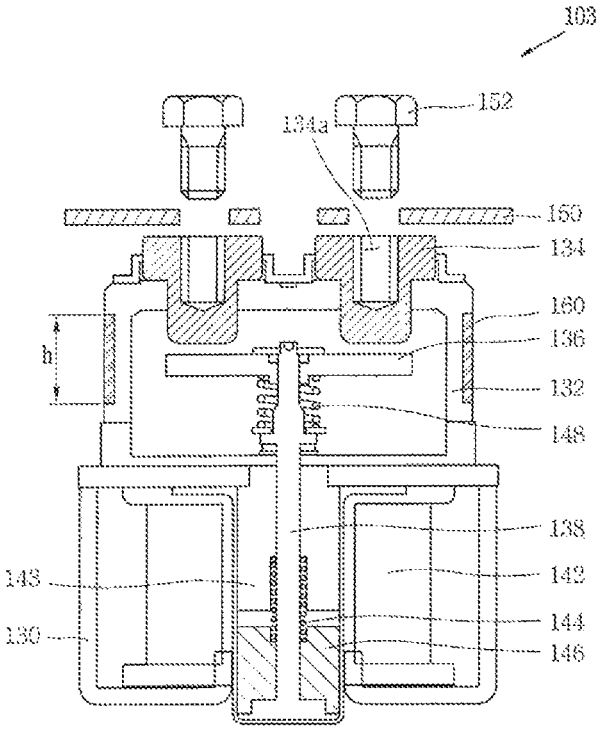
FIG. 3 is a sectional view taken along line 'A-A' in FIG. 2.

FIGS. 2 and 3 illustrate a structure of the relay for an electric vehicle according to a first embodiment of the present invention. More specifically, FIG. 2 is a perspective view of the relay, and FIG. 3 is a sectional view taken along line 'A-A' in FIG. 2.

As shown in FIG. 2, the relay 103 of the present invention includes a housing 132, and a case 130 formed below the housing 132.

In the housing 132, provided are a fixed contact 134, a movable contact 136, a shaft 138, and a contact spring 148. The housing 132 extends toward the case 130 to contact an upper surface of the case 130, thereby sealing the fixed contact 134, the movable contact 136, the shaft 138, and the contact spring 148. Preferably, the housing 132 is formed of a material having a heat resistance and a wear resistance and capable of being fabricated easily (for example, ceramic). And the fixed contact 134 and the movable contact 136 are preferably formed of a metallic material having a high conductivity (for example, copper).

A screw hole 134*a* is formed at the fixed contact 134, and a cable or a busbar 150 for transmitting a current to a load side is coupled to the fixed contact 134 by a screw 152.

The fixed contact 134 is disposed on the housing 132, and is connected to the motor and each component of the electric vehicle. And the movable contact 136 contacts or is separated from the fixed contact 134 by moving up and down, thereby supplying a current to the motor or the load or interrupting current supply thereto. And the contact spring 148 maintains a contacted state between the movable contact 136 and the fixed contact 134 with a pressure more than a predetermined value when the movable contact 136 contacts the fixed contact 134 by elasticity.

An electric actuator is disposed in the case 130. The electric actuator includes a magnetizing coil 142, a fixed core 143, a movable core 146, a return spring 144, and a shaft 138 which passes through the case 130 from the upside in a shaft direction.

The magnetizing coil 142 has a cylindrical inner side, and generates an electromagnetic force by an electric signal to generate a driving force of the fixed core 143 and the movable core 146. And the fixed core 143 is disposed in the magnetizing coil 142. The movable core 146 is formed to have a cylindrical shape, and is disposed below the fixed core 143 at an empty space inside the magnetizing coil 142.

The movable core 146 is called an amateur, and is provided with a through hole to fix another end of the shaft 138 in a penetrating manner. The movable core 146 is upward moved by an electric force generated from the magnetizing coil 142. The upward movement of the movable core 146 is transmitted to the movable contact 136 through the shaft 138, thereby making the movable contact 136 move up and down.

The return spring 144 is disposed between the fixed core 143 and the movable core 146, and returns the movable core 146 to the original position by elasticity when the movable core 146 is driven up and down.

The shaft 138 is coupled to the movable core 146, and is coupled to the contact spring 148 and the movable contact 136 by passing through a central region of the fixed core 143 and the return spring 144 in a shaft direction. As the movable core 145 moves by an electromagnetic force, the shaft 138 is upward moved. As a result, the movable contact 136 is upward moved to contact the fixed contact 134.

A permanent magnet 160 for removing an arc generated when the movable contact 136 contacts the fixed contact 134 is disposed outside the housing 132. Generally, when current supply to the motor or the load of the electric vehicle is interrupted as the movable contact 136 and the fixed contact 134 inside the housing 132 are separated from each other, an arc and heat are generated near the movable contact 136 and the fixed contact 134. Since the arc is a current flow, the current interruption is delayed by the arc even when the movable contact 136 and the fixed contact 134 are separated from each other. As a result, driving of the motor or the load of the electric vehicle may not be precisely controlled. In order to control the motor or the load through rapid current interruption, an arc generated between the movable contact 136 and the fixed contact 134 should be extinguished.

In the present invention, the permanent magnet 160 is provided to extinguish an arc generated between the movable contact 136 and the fixed contact 134. That is, the permanent magnet 160 extinguish the arc by enlarging the arc. If the arc is enlarged, the arc becomes thinner and broken in the end. The breaking of the arc means the elimination of the arc, namely the current by the arc is interrupted.

Since the permanent magnet 160 is provided to interrupt a current flow by an arc, a current applied to the motor and the components of the electric vehicle is rapidly interrupted. This may allow the motor and the components to be controlled precisely.

As shown in FIG. 3, the permanent magnet 160 is positioned to correspond to outside of a contact region between the movable contact 136 and the fixed contact 134. The reason is in order to smoothly extend an arc by inducing arc generation between the movable contact 136 and the fixed contact 134. Therefore, it is preferable to set a width (h) of the permanent magnet 160 to be large enough to cover the movable contact 136, the fixed contact 134 and a region therebetween.

Figure 4:
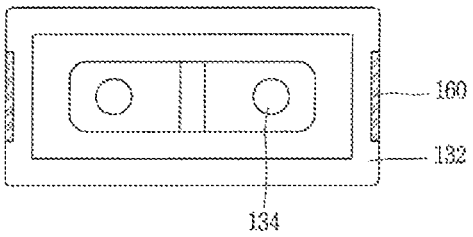
FIG. 4 is a planar view of FIG. 3.

FIG. 4 is a planar view of FIG. 3. As shown in FIG. 4, the fixed contact 134 and the movable contact 136 are disposed in a region enclosed by the housing 132. And the permanent magnet 160 is formed at an outer periphery of the housing 132. The housing 132 may be formed of ceramic, and the permanent magnet is mainly formed of an alnico-based material using Al, Ni and Co as a main component or a neodymium-based material using Nd, Fe and B as a main component.

The housing 132 and the permanent magnet 160 are integrally formed with each other. That is, the housing 132 and the permanent magnet 160, which have been fabricated individually, are not attached to each other. Rather, the housing 132 and the permanent magnet 160 are integrally formed with each other through the same processes. This will be explained later in more detail.

The reason why the housing 132 and the permanent magnet 160 are integrally formed with each other is as follows.

The permanent magnet 160 may be separately formed from the housing 132, and then may be attached to each other. However, in this case, since the permanent magnet 160 is provided in the relay 103 separately from the housing 132, a size of the relay 103 is increased by a size of the permanent magnet 160. In order to minimize the size increase of the relay 103, the size of the housing 132 should be reduced, and the size of the permanent magnet 160 should be minimized. However, in this case, an arc extinguishing function is lowered due to a small size of the permanent magnet 160. This may cause an arc not to be smoothly extinguished. Further, even in case of minimizing a size of the relay 103, the relay 103 may have a larger size than the conventional relay.

In the present invention, as the permanent magnet 160 is integrally formed with the housing 132, part of the housing 132 is replaced by the permanent magnet 160. This may allow the relay 103 to execute an arc extinguishing function without its size increase. In the present invention, since the size of the permanent magnet 160 is controllable, an arc extinguishing function may be maximized.

As shown in FIG. 4, the permanent magnet 160 may be integrally formed with the housing 160 along two short sides of the housing 132 having a rectangular shape. However, the present invention is not limited to this.

Figure 5A:
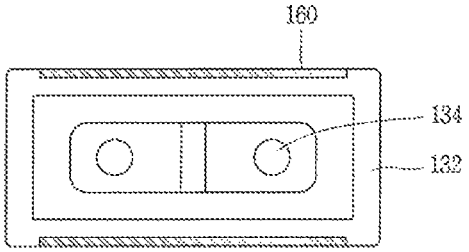
FIGS. 5A and 5B are planar views illustrating another structure of a relay according to another embodiment of the present invention.
Figure 5B:
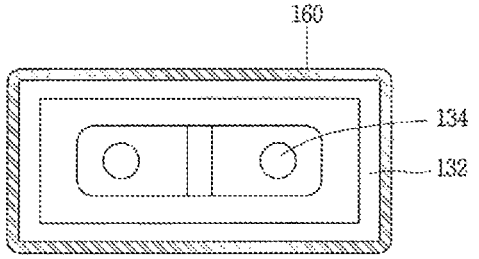

As shown in FIG. 5A, the permanent magnet 160 may be integrally formed with the housing 160 along two long sides of the housing 132 having a rectangular shape. Alternatively, as shown in FIG. 5B, the permanent magnet 160 may be integrally formed with the housing 160 along four sides of the housing 132 having a rectangular shape.

A position of the permanent magnet 160 is variable according to an intensity of an arc to be induced and to be extended. Thus, the position of the permanent magnet 160 may be determined based on a size of the housing 132, an interval between the fixed contact 134 and the movable contact 136, an intensity of a voltage applied to the fixed contact 134, etc.

And an area of the permanent magnet 160 integrally formed with the housing 132 on the sides of the housing 132 may be also determined based on a size of the housing 132, an interval between the fixed contact 134 and the movable contact 136, an intensity of a voltage applied to the fixed contact 134, etc.

Figure 6:
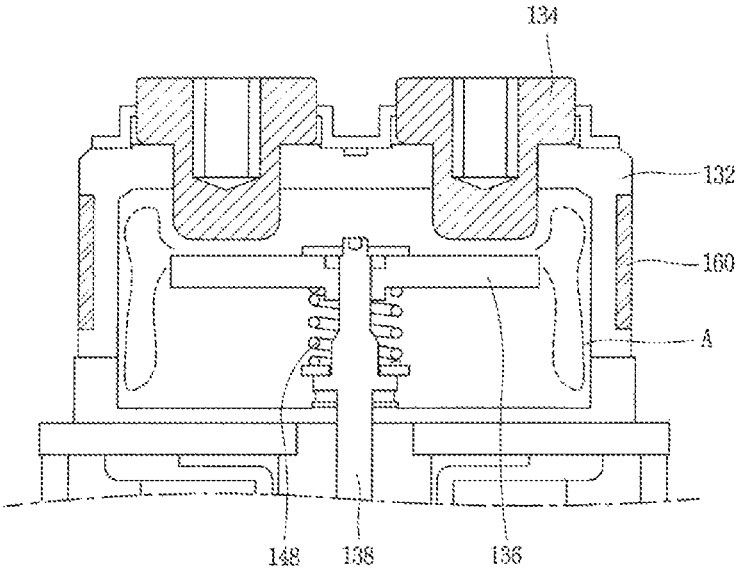
FIG. 6 is a view illustrating that an arc is extended in a relay according to the present invention.

FIG. 6 illustrates that an arc (A) has an increased length by the permanent magnet 160. As shown in FIG. 6, the arc (A) occurring between the movable contact 136 and the fixed contact 134 is induced to be extended by the permanent magnet 160 having a magnetic property. As the arc (A) has an increased length, the amount of the arc (A) between the movable contact 136 and the fixed contact 134 is reduced. As the arc (A) is more extended to have a more increased length, the arc (A) between the movable contact 136 and the fixed contact 134 is extinguished. As a result, a region between the movable contact 136 and the fixed contact 134 is interrupted, and current supply to the motor and the components of the electric vehicle is interrupted to cause driving of the motor and the components to be stopped.

As aforementioned, in the present invention, since the arc (A) occurring between the movable contact 136 and the fixed contact 134 is extended by the permanent magnet 160, a current flow to a region between the movable contact 136 and the fixed contact 134 by the arc when the movable contact 136 and the fixed contact 134 are separated from each other is rapidly interrupted. This may allow the motor and the components of the electric vehicle to be controlled precisely. Further, in the present invention, since the permanent magnet 160 is integrally formed with the housing 132, a size increase of the relay 103 may be prevented.

Hereinafter, a method of manufacturing a relay according to the present invention will be explained with reference to the attached drawings.

Figure 7:
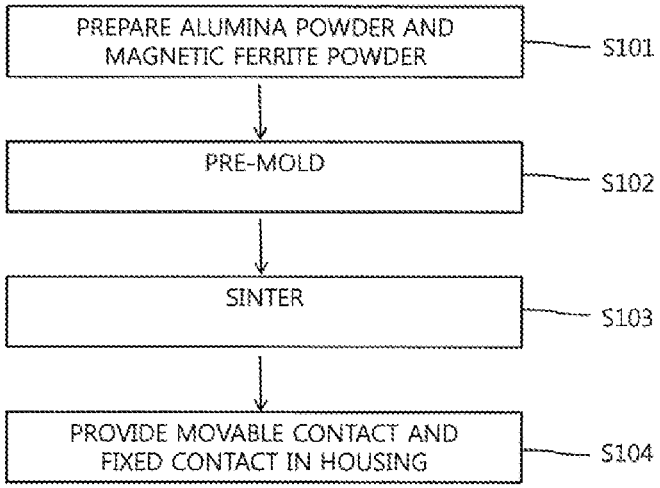
FIG. 7 is a flowchart illustrating a method of manufacturing a relay according to the present invention.

FIG. 7 is a flowchart illustrating a method of manufacturing a relay according to the present invention.

As shown in FIG. 7, prepared are alumina powder ($Al_2O_3$) having a size of about 8-12 μm, and magnetic ferrite powder ($FeO_3$) having a size of about 8-12 μm (S101). The magnetic ferrite powder may include alnico-based powder having Al, Ni and Co as a main component, or neodymium-based powder having Nd, Fe and B as a main component.

Then, the alumina powder and the magnetic ferrite powder are pre-molded to have a shape of the housing (S102). The housing is formed by forming magnetic ferrite on two sides facing each other or four sides of a quadrangular shape formed of alumina. Alternatively, the housing including a magnetic ferrite dummy of a permanent magnet shape may be formed by pre-molding the alumina powder and the magnetic ferrite powder. Still alternatively, magnetic ferrite powder may be pre-molded to have a dummy shape, and alumina powder may be pre-molded to have a housing shape. Then, the magnetic ferrite of a dummy shape may be inserted into the alumina of a housing shape.

By the pre-molding, an interfacial surface is formed between the magnetic ferrite and the alumina. As the magnetic ferrite powder and the alumina powder are formed to have a small size as much as possible (i.e., about 8-12 μm), an interfacial energy therebetween is maximized.

Then, the powder is heated on a high-temperature furnace such as an electronic furnace, at a temperature of about 1350-1450° C. for about 12 hours, thereby sintering the pre-molded housing. However, the pre-molded housing is heated at an electric furnace at a room temperature of 1350-1450° C., for about 6 hours. Then, after a sintering process, the pre-molded housing is cooled at a room temperature of 1350-1450° C., for about 6 hours. As a result, the pre-molded housing is substantially heated and cooled for about 24 hours.

Generally, magnetic ferrite and alumina have a stable and low energy state. When the magnetic ferrite and alumina are in a powder state, a surface area thereof is increased and thus a surface energy thereof is increased. However, in case of pre-molding the magnetic ferrite and the alumina in a housing shape, powder is formed to have a specific shape, and a surface energy of the magnetic ferrite and the alumina is not changed.

If the pre-molded housing is heated at a high temperature, powder particles cling to each other to be sintered and to be in a low energy state. That is, since magnetic ferrite powder and alumina powder are granulated by heating, powder particles having many pores and scarcely having a strength are bonded to each other without a density change. As a result, a surface area of the powder is reduced, and a strength of the powder is enhanced. Further, since magnetic ferrite powder and alumina powder undergo a densification process by heating, powder particles having many pores and a low strength have a density increase (i.e., the number of the pores is reduced), and have a high coupling force therebetween. As a result, a strength of the powder is enhanced.

After the housing 103 having a high intensity is fabricated by sintering, the fixed contact 134 and the movable contact 136 are installed in the housing 103. Then, the housing 103 is assembled with the case 130 having an electric actuator, thereby fabricating the relay 103.

As aforementioned, in the present invention, the relay is provided with the permanent magnet to induce an arc generated from the fixed contact and the movable contact, thereby extending a length of the arc. As the arc has an increased length, it may be rapidly removed. This may allow a current flow by the arc to be interrupted. Since a current may be rapidly supplied to a motor, components, etc. of the electric vehicle or the current supply may be rapidly interrupted, the motor or the components may be precisely controlled.

In the present invention, since the permanent magnet is integrally formed with the housing, a size increase of the relay due to the permanent magnet may be prevented. This may maximize an arc extinguishing function of the relay without a size increase of the relay.

The aforementioned descriptions illustrate a relay having a specific structure. However, the present invention is not limited to this. In the present invention, since the permanent magnet is integrally formed with the housing of the relay, a size increase of the relay is prevented, and an arc extinguishing function is enhanced. Any known relays may be applied to the present invention, only if a permanent magnet is integrally formed with a housing.

Further, the aforementioned descriptions illustrate that the relay of the present invention is used in an electric vehicle. However, this is merely for convenience. That is, the relay of the present invention may be applied not only to an electric vehicle, but also to a hybrid vehicle using electricity and an engine and various types of industrial facilities or machines.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A method of fabricating a relay, comprising:

pre-molding powder for a permanent magnet and powder for ceramic;

sintering the pre-molded powder, thereby forming a housing integrated with a permanent magnet; and providing a movable contact and a fixed contact in the housing, and assembling the housing with an electric actuator, wherein the sintering the pre-molded powder includes heating the powder at a temperature of 1350-1450° C. for 12 hours.

2. The method of claim 1, wherein the powder for the permanent magnet includes:

magnetic ferrite powder; and an alnico-based material or a neodymium-based material added to the magnetic ferrite powder.

3. The method of claim 2, wherein the magnetic ferrite powder has a size of 8-12 μm.

* * * * *